US005213069A

United States Patent [19]

Curtil

[11] Patent Number: 5,213,069

[45] Date of Patent: May 25, 1993

[54] TWO-STROKE SUPER CHARGED ENGINE AND PROCESS FOR OPERATING

[76] Inventor: Rémi E. Curtil, 7, rue Fortuny, 75017 Paris, France

[21] Appl. No.: 845,536

[22] Filed: Mar. 4, 1992

Related U.S. Application Data

[63] Continuation of Ser. No. 576,420, Sep. 24, 1990, abandoned.

[30] Foreign Application Priority Data

Mar. 25, 1988 [FR] France ..... 88 04002

[51] Int. Cl.[5] ..... F02B 75/02

[52] U.S. Cl. ..... 123/65 A; 123/65 W; 123/193.5

[58] Field of Search ..... 123/65 R, 65 A, 65 P, 123/65 W, 65 PE, 73 PP, 193.5

[56] References Cited

U.S. PATENT DOCUMENTS

| | | | |
|---|---|---|---|
| 4,248,185 | 2/1981 | Jaulmes | 123/65 A |
| 4,321,893 | 3/1982 | Yamamoto | 123/65 A |
| 4,719,880 | 1/1988 | Schlunke et al. | 123/193 H |
| 4,899,698 | 2/1990 | Thery | 123/65 A |

FOREIGN PATENT DOCUMENTS

| | | | |
|---|---|---|---|
| 0155554 | 8/1937 | Fed. Rep. of Germany | 123/65 A |
| 0769037 | 6/1934 | France . | |
| 0045284 | 7/1935 | France . | |
| 0037627 | 3/1977 | Japan | 123/65 A |
| 0467094 | 6/1937 | United Kingdom | 123/65 A |

*Primary Examiner*—Noah P. Kamen

*Attorney, Agent, or Firm*—Cushman, Darby & Cushman

[57] ABSTRACT

A two-stroke internal combustion engine is provided with a cylinder and a piston reciprocatingly mounted in the cylinder; the cylinder has two inlet ducts each having a inlet port opening into the cylinder for delivering a inlet strain to the cylinder and an exhaust duct having an exhaust port opening in the cylinder for removing an exhaust product from the cylinder with the inlet ducts and ports disposed so that the inlet stream impacts the wall of the cylinder at a substantially identical location between the exhaust port and an end of the cylinder opposite the piston with the inlet ports and exhaust ports arranged to eliminate crossing of the inlet streams and the exhaust stream.

13 Claims, 2 Drawing Sheets

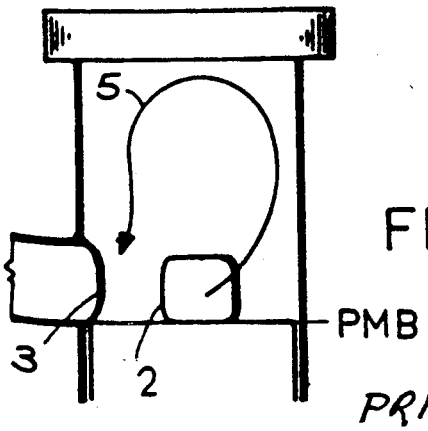
FIG.1a
PRIOR ART
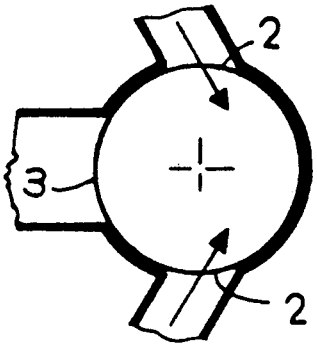
FIG.1b
PRIOR ART
FIG. 2
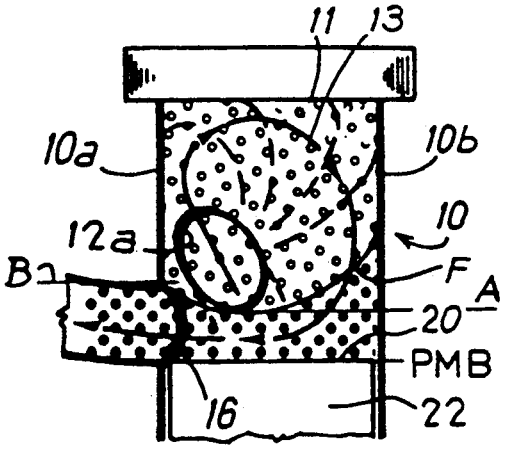
FIG. 3
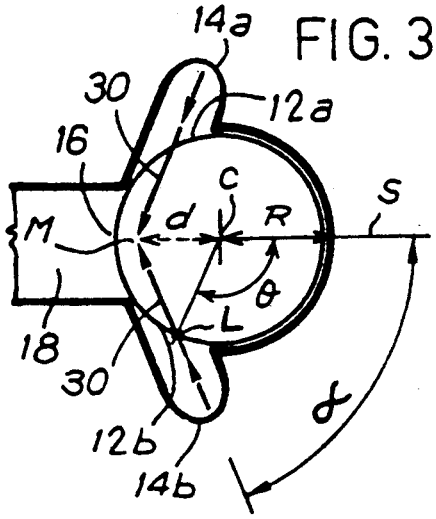
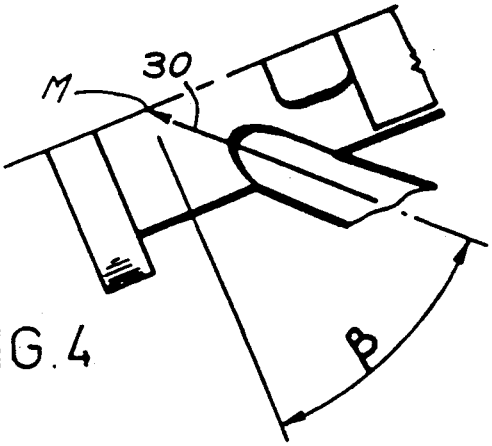
FIG.4
FIG.5
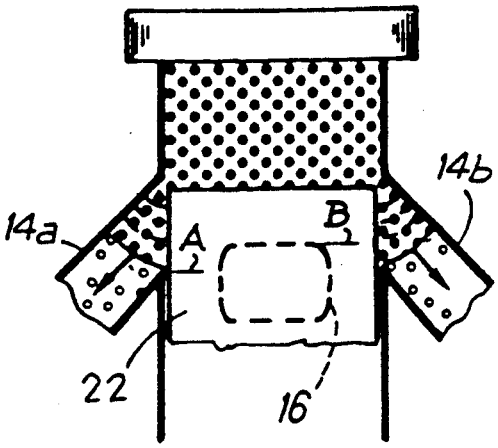

TWO-STROKE SUPER CHARGED ENGINE AND PROCESS FOR OPERATING

This is a continuation of application Ser. No. 07/576,420, filed on Sep. 24, 1990, which was abandoned upon the filing hereof.

BACKGROUND OF THE INVENTION

1. Field of the Invention

The present invention concerns a process and device for scavenging of a two-stroke internal combustion engine, with a linearly reciprocating piston, of the type autosupercharged by afterfilling effect, in which the distribution of each cylinder is exclusively assured by the piston in combination with the inlet port-inlet duct set and with the exhaust port-exhaust duct set, the inlet port set being exposed by the piston for a longer time than the exhaust port set, and a two-stroke engine provided with such scavenging.

More specifically, the invention is essentially aimed at a process and device for arrangement of the outflow for the temporary back-scavenging of the gases burnt in the inlet ducts during the pre-exhaust phase preceding opening of the exhaust ports, then for their reintroduction followed by introduction of the scavenging air proper inside the cylinder to improve the output of such an engine. All the air reaching the cylinder, whether for scavenging or for afterfilling, consequently enters by the inlet duct. This type of engine autosuper-charged by afterfilling effect utilizes the direct action of the gases emerging from one cylinder on an air supply for its compression and introduction into one cylinder of an opportune instant in the cycle to supercharge it. The phases of cylinder-air supply-cylinder pressure transfer operate in an essentially closed environment in such a manner as to avoid any energy loss to the outside.

Afterfilling is thus understood to mean in the introduction of an additional air charge into the cylinder, after scavenging and closure of the exhaust apertures.

It will be generally appropriate below to describe scavenging air as being the scavenging agent intended to renew the burnt gases of the cylinder, whether this be pure air or any other combustion supporter-fuel mixture.

2. Description of the Prior Art

Engines of the aforesaid type are already known, notably such a two-stroke engine, constituted by at least one set of two cylinders, whose operating cycles are wedged in relation to each other at a crank-shaft angle of 180°, in which the energy of the pre-exhaust gases of one cylinder is utilized to accomplish afterfilling of the other cylinder, is described in FR-A-s 346 558 or its equivalent CH-A-593 420 of the present applicant, and represented in FIGS. 1-5 of this publication.

Another process described in French Patent Application No. 87 04757 of the present applicant also presents an engine of the aforesaid type accomplishing autosupercharging of each cylinder by itself by an afterfilling effect through the use of an air supply pressurized by the action of the energy of the pre-exhaust gases.

A preferred version of the device for embodiment of the process also forms the object of a PCT-form co-application filed by the inventor under No. PC-FR 88/00155 published under No. WO 88/08073.

To facilitate continuation of the description, it will be appropriate to understand the term "double-cylinder solution", the latter forming the object of FR-A-2 346 558 or CH-A-593 420, as meaning that it may also be applied to a multiple of a set of two cylinders, and the term "single-cylinder solution", the latter being intended to embody the process according to French Patent Application No. 87 04757, as meaning that it may be applied in a universal manner, whatever the number and arrangement of the cylinders.

Before any description of the constraints specific to this particular type of two-stroke engine, it is appropriate to recall the purpose of scavenging in the two-stroke engine in general; its purpose is to be able to expel from the cylinder the gases burnt in the preceding cycle:

1) with the smallest possible quantity of scavenging air;

2) as completely as possible;

3) with the smallest possible scavenging air loss;

4) with the smallest possible energy expenditure, applied for this effect;

5) within the allotted time imposed by the engine closure conditions;

6) with intense as possible cooling of the cylinder and piston head;

7) benefiting, if possible, from the natural descending and then ascending motion of the piston to maintain the aerodynamics of scavenging.

Scavenging of an engine of the specific type described above and forming the object of the invention while satisfying in the best way possible general constraints 1)-7) noted above should moreover simultaneously resolve a set of particular constraints specified below. These supplementary particular constraints are inherent in the principle of operation of both the double-cylinder solution and single-cylinder solution and are as follows:

8) to organize temporary back-scavenging of the gases burnt in the scavenging ducts, then their return in the cylinder direction in such a manner that they mix as little as possible with the scavenging air, which excludes the possibility of imposing on the scavenging ducts a shape using excessively small radii of curvature;

9) to accomplish a form of scavenging inside the cylinder with the aid of the exhaust gases emerging from the scavenging ducts and then with the aid of the scavenging air front proper consistent with criteria 1)-7) noted above in a manner equivalent to what is obtained in engines of the conventional type where the inlet ports are exposed by the piston for a longer time than the scavenging ports, i.e. through the creation of a scavenging air front as unified and as concentrated as possible in such a manner as to avoid the creation of islets of burnt gases inside the scavenging zone (difficulty of synchronizing the return of several scavenging air fronts emerging from different ducts with different individual length and/or volumes);

10) an as reduced as possible interaxis distance between the cylinders for the double-cylinder solution or for the single-cylinder solution applied to a multi-cylinder engine;

11) to provide the scavenging ducts, in which the phenomenon of pressure exchange is to progress in a closed environment for the cylinder-scavenging duct-supercharged volume system (associated cylinder wedged at 180° for the double-cylinder solution and piston internal air supply for the single-cylinder solution), with an optimum volume to achieve the maximum afterfilling effect. The theoretical optimum volume (the pre-exhaust gases then occupying a volume equal to that of the scavenging ducts) in actual fact depends on the extent of the envisaged afterfilling effect, which itself depends on the thermo-dynamic state of the gases under expansion (factor highly dependent specifically on the air-fuel ratio and the rate of the residual gases with which combustion has taken place). The true optimum volume of the scavenging ducts should naturally be greater than the theoretical optimum volume to avoid any risk of afterfilling by the burnt gases but also as little as possible, lest there should be any impairment, on the one hand, of the autosupercharging potential (decrease in the pressure level attained in the noted ducts if the energy supplied by the pre-exhaust gases is distributed over an excessive volume) and, on the other, of the engine output (increased loss of expansion in the cylinder without any beneficial effect on the increase in afterfilling thus obtained);

12) to provide the noted scavenging ducts with a length necessary for the creation of the optimum volume as explained in 11) above, but as small as possible in such a manner as to maximize the engine conditions, at which an afterfilling effect would still be just attained (any increase in the conditions causes a quasio-proportional increase in the passage time, expressed in crankshaft degrees, of the pressure wave due to expansion of the pre-exhaust gases).

The difficulty of simultaneously satisfying the set of these requirements has considerably impeded development of this type of engine.

Document CH-A-593 420 noted above presents only one schematic arrangement, on the basis of which it is impossible to gather any information able to result in a global technical solution satisfying the set of these requirements. In fact, it does not take into account the architectural constraints specific to an arrangement of two cylinders with parallel axes noted in 10). Constraint 8) is only partially taken into account and moreover does not allow proposal of a solution satisfying constraints 9)–12). In particular, the scavenging system presented is of transverse type with a piston head in the shape of a deflector. This scavenging system, known per se, leads to a relatively mediocre scavenging output.

Other scavenging forms of loop type, also known under the name of "Schnurle" scavenging, have been tested. They have allowed better consideration, although imperfectly, cf the constraint noted in 9), though without satisfying the other requirements, notably 8), 11), and 12).

The evolution of the scavenging technology of engines of conventional type with distribution exclusively assured by the piston in combination with exhaust ports and inlet has finally adopted, despite the large number of devices proposed, only the Schnurle loop solution noted above, which consists in admission of scavenging air into the cylinder with its impingement initially on the piston head, then on the lower part of the cylinder in immediate proximity of the piston head diametrically opposite the exhaust ports, then on the base of the cylinder head, and finally on the cylinder wall situated above the exhaust ports before undergoing an inflection in the opposite direction towards the exhaust ports.

Also known according to German Patent DE-477 041 KRUPP, cited in a book on scavenging written by VENEDIGER, printed by FRANCKHISCHE VERLAGSHANDLUNG, Abt. Technik, Stuttgart, 1947, and quoted in French Patent FR-A-769 039, is a scavenging system said to be of inverse loop type consisting in admission of scavenging air with its intended impingement on the wall of the cylinder liner situated above the exhaust ports.

This inverse loop system has not achieved any success, since it notably presents the inconvenience of causing an increase in the rising flows of scavenging air in the direction of the intended liner wall and of the flow of burnt gases emerging towards the exhaust ports, with a major contact area and insufficient impingement of scavenging air at its entry into the cylinder, while thus realizing two characteristics that should be carefully avoided if it is desired to guarantee sufficient scavenging stability (see page 73, first paragraph, of the book by VENEDIGER).

There has consequently been prejudice in the art for use of inverse loop scavenging.

In all proposed solutions proposed the frame of inverse loop scavenging, in the same way as in virtually all other known solutions, the lower edge of the inlet ports coincides with the position of the piston head at the bottom dead center (see particularly FIG. 1 of FR-769 037 or FR-E-45284).

SUMMARY OF THE INVENTION

A main purpose of the invention is to propose a global technical solution to the problems raised while simultaneously satisfying the set of the requirements noted above.

Another objective of the invention is to retain at the maximum level the advantages described in both above-noted patents CH-A-593 420 (double cylinder) and FR-87 04757 (single cylinder).

Another main purpose of the invention is to solve the new technical problem consisting in the provision of a solution allowing, within the frame of autosupercharging by afterfilling, the use of an inverse loop while eliminating the inconveniences inherent in this loop as noted by VENEDIGER.

The present invention for the first time solves the technical problem in a manner totally not evident to the man of the art while casting aside the prejudices of the latter relating to the use of an inverse loop and to the positioning of the lower edge of the inlet port at bottom dead center level.

An additional objective is to organize a major turbulence field ensuring a good mixture of air and fuel during the combustion phase under all loadings and under all engine operating conditions while avoiding, in the specific case of the controlled ignition engine, any loss of fuel into the exhaust.

To this end, the invention provides, in a first respect, a process for scavenging of a two-stroke internal combustion engine autosupercharged by afterfilling effect, in which the distribution of each cylinder is exclusively assured by the piston in combination with the inlet port-inlet duct set, referred to below as the inlet set, and with the exhaust port-exhaust duct set, referred to below as the exhaust set, the inlet ports being exposed by the piston for a longer time than the exhaust ports, incorporating an afterfilling phase in an essentially closed environment, all the air reaching the cylinder entering by the inlet set, characterized in that the scavenging air flows originating from the inlet set are directed so that they recombine at an impact point situated on the upper wall of the cylinder situated above the exhaust ports to perform a loop said to be inverse, thereafter impinging on the cylinder head, then on the cylinder wall diametrically opposite the exhaust ports, and finally on the piston head before reaching the exhaust ports, and the inlet ports are arranged relatively to the cylinder in such a manner that all the possibilities of increase in the airflow entering the cylinder with the flow of burnt gases emerging from the cylinder on the path between the entry points of the scavenging airflow and their impact point are virtually completely eliminated.

Accordingly to a particularly advantageous embodiment, the process according to the invention is characterized in that a separation front of the burnt gases with the scavenging air is accomplished virtually perpendicularly to the centerline of the inlet ducts.

According to another particular characteristic of the process according to the invention, the sets of inlet ducts are arranged in pairs, each pair able to have a different inclination in such a manner that the point of encounter of the principal vectors of the flows of all the pairs is situated at a virtually identical height, the whole arrangement operating to create a unified ascending airway having, notably in immediate proximity of the cylinder head before undergoing its first inflection, a maximum speed along the cylinder wall and progressively decreasing before being virtually completely canceled on the vicinity of the longitudinal plane of the cylinder separating the ascending current and descending current.

According to an embodiment version, the engine is not cooled, and notably the inlet ducts at low loadings.

The invention concerns, in a second respect, a device for scavenging of a two-stroke internal combustion engine autosupercharged by afterfilling effect, in which the distribution of each cylinder is exclusively assured by a linearly reciprocating piston in combination with an inlet port-inlet duct set, referred to below as the inlet set, and with an exhaust port-exhaust duct set, referred to below as the exhaust set, whose inlet ports are exposed by the piston for a longer time than the exhaust ports, incorporating afterfilling means in an essentially closed environment, the inlet set serving as the only path for supply of air to the cylinder, characterized in that the inlet set is arranged relatively to the cylinder so that the scavenging air flows originating from the inlet set recombine at an impact point situated on the upper wall of the cylinder situated above the exhaust ports to perform a loop said to be inverse; and the height of the lower edge of the inlet ports is arranged sufficiently high in the cylinder relatively to the height of the upper edge of the exhaust ports to eliminate virtually completely any possibility of increase in the airflows entering the cylinder with the flow of burnt gases emerging from the cylinder on the path between the entry points of the airflows and their impact point.

According to an advantageous embodiment, this device is characterized in that the inlet ducts are inclined at an angle of elevation in relation to the cylinder in such a manner as to accomplish, during pre-exhaust, a separation front of the burnt gases with the scavenging air virtually perpendicularly to the centerline of the inlet ducts.

Other embodiment versions are specified in the subclaims and are incorporated here for reference.

Finally, in a third respect, the invention also concerns an engine equipped with such a device or embodying the previously specified process.

Other purposes, characteristics, and advantages of the invention will appear in the light of the explanatory description given with reference to the attached drawings given simply by way of illustration and which should not in any way limit the scope of the invention.

BRIEF DESCRIPTION OF THE DRAWINGS

FIGS. 1*a*, 1*b* schematically represent, in axial vertical section, a cylinder of a two-stroke engine whose inlet and exhaust ducts are symmetrically arranged in relation to the plane of symmetry of scavenging in such a manner as to accomplish the conventional Schnurle loop of the previous background art;

FIG. 2 schematically represents a view similar to that shown in FIG. 1, but of a device conforming to the invention allowing embodiment of the pressure according to the invention;

FIG. 3 represents a cross-sectional view of the device according to the invention in FIG. 2, which incorporates a single set of two inlet ports and a single set of one exhaust port according to an actually preferred embodiment;

FIG. 4 represents a cutback half-section of the vertical plane parallel to the cylinder axis incorporating the vector of the main direction of the gas flow emerging from the inlet duct represented in FIG. 3 by arrow 30;

FIG. 5 represents another vertical section passing through arrows 30 of FIG. 3, showing both inlet ducts symmetrically arranged in relation to the exhaust ducts forming the object of FIG. 3 and represents the start of pre-exhaust by showing the gas separation front;

DETAILED DESCRIPTION OF THE INVENTION

Figure 6:
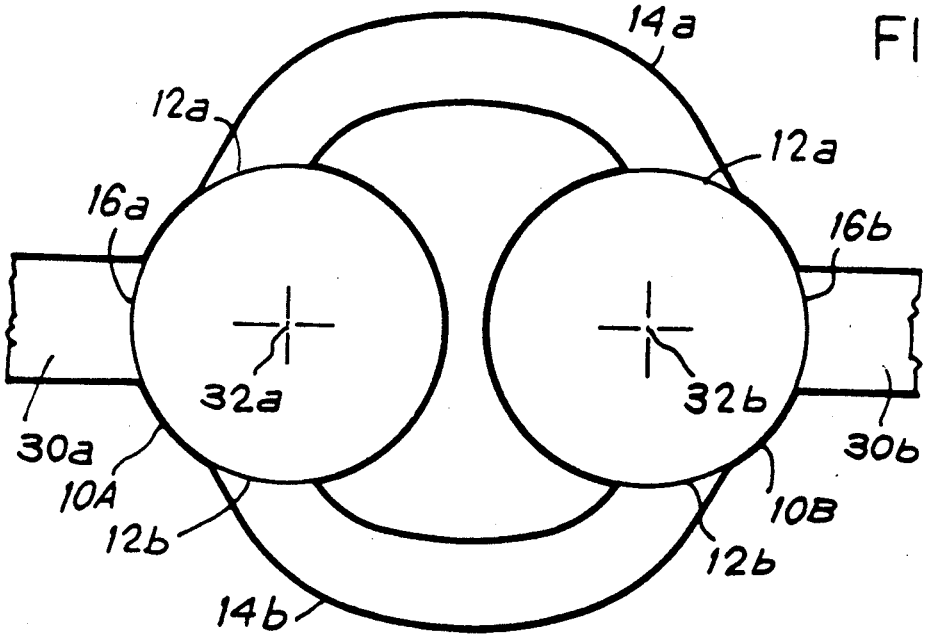
FIG. 6 represents an embodiment of an engine equipped with two cylinders wedged at 180°.
Figure 7A:
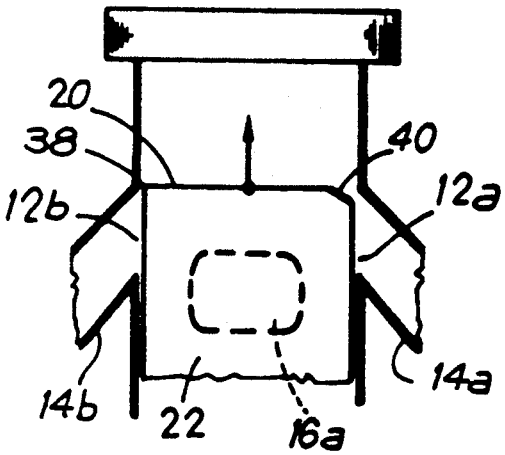
FIGS. 7*a*, 7*b* represent an embodiment version of the invention with a local reduction in way of one of the two inlet ports.
Figure 7B:
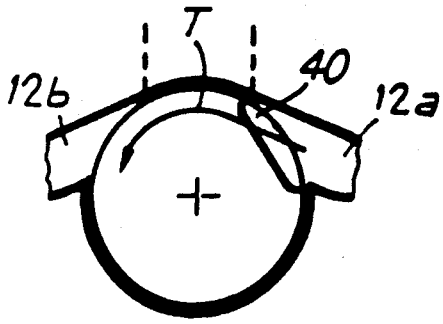

With reference to FIG. 1, it may be noted that, according to the Schnurle device, cylinder 1 incorporates at least two inlet ports 2 and at least one exhaust port 3, the lower edge of the inlet port is conventionally situated at bottom dead center (BDC) level, which also coincides with the lower edge of the exhaust port. Moreover, in a determinate manner, the exhaust port is arranged in one cylinder wall virtually opposite the cylinder wall towards which the scavenging airflows emerging from inlet ducts 2 converge.

According to this Schnurle device, scavenging of burnt gases according to loop 5 represented in FIG. 1 said to be a Schnurle loop is thus obtained.

With reference to FIGS. 2–5, a scavenging device according to the invention is represented, according to which cylinder 10 incorporates a set of inlet ports 12*a*, 12*b* and inlet ducts 14*a*, 14*b* (inlet set), as is well evident from FIGS. 2–5, and a set of exhaust ports 16 and exhaust ducts 18 (exhaust set). Inlet ports 12*a*, 12*b* are laterally arranged in cylinder 10 relatively to exhaust ports 16 in such a manner that inlet ports 12*a*, 12*b* are exposed by the piston for a longer time than exhaust ports 16.

According to the invention, the inlet set (12*a*, 12*b*; 14*a*, 14*b*) is arranged relatively to the cylinder (10) so that the scavenging air flows originating from the inlet ports (12*a*, 12*b*) recombine at an impact point situated on the upper wall (10*a*) of the cylinder (10) above the exhaust ports 16) to perform a loop said to be inverse; and the height (A) of the lower edge of the inlet ports (12*a*, 12*b*) is arranged sufficiently high in the cylinder (10) relatively to the height (B) of the upper edge of the exhaust ports (16) to eliminate virtually completely any possibility of increase in the airflows entering the cylinder (10) with the flow of burnt gases emerging from the cylinder (10) on the path between the entry points of the airflows and their impact point.

By preference, the height (A) of the lower edge of the inlet ports (12*a*, 12*b*) is situated in the vicinity of or above the height (B) of the upper edge of the exhaust ports (16).

According to another characteristic of the device according to the invention, inlet ducts 14*a*, 14*b* are laterally arranged symmetrically in relation to one plane of symmetry of scavenging which virtually coincides with the longitudinal plane of symmetry of the cylinder passing through the exhaust ports.

Moreover, inlet ports 12*a*, 12*b* and exhaust ports 16 are symmetrically arranged in relation to one plane of symmetry of scavenging noted above which here virtually coincides with the longitudinal plane of symmetry of the cylinder passing through exhaust port 16.

According to another characteristic of the device according to the invention, inlet ducts 14*a*, 14*b* are laterally arranged inclined in relation to the cylinder, according to angle of elevation beta noted in FIG. 4, in such a manner that the separation front of the burnt gases with the scavenging air is virtually perpendicular to the centerline of each inlet duct 14*a*, 14*b*, as represented in FIG. 5.

According to a particular embodiment, inlet ducts 14*a*, 14*b* are arranged in pairs, each pair able to have a different inclination in such a manner that the point of encounter of the flows of all the pairs is situated at a virtually identical height. By preference, the half-angle of arrow alpha defined by the angle between the line of the plane parallel to the axis of cylinder 10 containing the principal direction vector of the gas flow emerging from each of inlet ducts 14*a*, 14*b* and the line of the plain of symmetry of scavenging S clearly visible in FIG. 3 is arranged in combination with angle beta noted above in such a manner that the point of encounter M of the respective inlet airflows symbolized by arrow 30 of each pair is situated virtually in a zone included between the upper edge of inlet ports 12*a*, 12*b* and top 11 of cylinder 10. Advantageously, angle associated with each pair of inlet ports 12*a*, 12*b*, defined by the angle included between the plane of symmetry of S and radius CL, L being the point of intersection of arrow 30 with cylinder 10, ranges between around 45° and around 135°. In the case of the presence of a single pair of inlet ports, as represented, angle advantageously ranges between 70° and around 110°.

According to an actually preferred embodiment, as represented, this device incorporates a single set of two inlet ports 12*a*, 12*b* and a single set of one exhaust port 16, or of two exhaust ports 16.

It is thus evident that, with such a device according to the invention, the best possible scavenging is obtained according to an inverse loop in relation to the conventional Schnurle loop by thus improving operation of a two-stroke engine autosupercharged by afterfilling.

The separation front of the burnt gases and scavenging air is similarly virtually at right-angles or perpendicular in relation to the centerline of the inlet ducts.

FIG. 2 distinguishes the different fluids present by representing the burnt gases or pre-exhaust or exhaust by closed circles and the inlet scavenging air by open circles. This diagram also represents by mixed lines the intermediate positions of the gas separation front and by continuous lines the front F of the effectively represented position. Arrow 13 moreover represents the motion of scavenging air circulation in the chamber according to the loop said to be inverse.

Various modifications can be made to the device according to the previously described invention without in any way transcending the frame of the invention.

It will be understood that angles of elevation beta and half-arrow alpha of the principal vectors (30) of the inlet ports in relation to the cylinder may vary within specific limits depending on the circumferential position of inlet ports 12*a*, 12*b*, defined by angle noted above, but also on the upper edges respectively of inlet ports 12*a*, 12*b* and exhaust ports 16 and on the stroke-bore ratio of cylinder 10 considered.

By way of an example, for the represented circumferential position of the version incorporating a single pair of inlet ports 12*a*, 12*b*, the arrow angle 92 alpha) of the pair of inlet ducts 14*a*, 14*b* of the embodiment shown in FIGS. 2–5, corresponding to an angle of around 110°, presents a value around 135° and the angle of elevation beta of the principal direction vector of the gas emerging from each inlet duct presents a value of around 45° and the point of encounter M visible in FIG. 3 of both planes containing principal direction 30 is situated at a distance=around 0.7 of the radius (R) of the cylinder in relation to center C.

According to another embodiment version, each set of inlet ducts 14*a*, 14*b* ends in a set of ports situated below the bottom dead center (BDC). These ports are intermittently communicated either with the inlet source or with a storage chamber arranged inside the piston, this solution being said to be single-cylinder.

In summary, according to the invention, an excellent scavenging output is achieved, including, for high stroke/bore ratio values, those superior to what is currently achievable with the conventional type of Schnurle loop scavenging system.

Maximum simplicity of the scavenging device, and thus of the engine, is obtained together with sufficient permeability caused by the favorable section-time diagram of the distribution of the particular type of two-stroke engine autosupercharged by afterfilling effect previously described, which, in a general way, makes it possible to start the scavenging phase of the scavenging ducts in a manner virtually coinciding with opening of the exhaust ports.

FIG. 6 represents an embodiment version of an engine equipped with the double-cylinder solution of the type described in CH-593 420, with the device according to the invention forming the object of preceding FIGS. 2–5, limited here by simplification to a module of two cylinders 10A, 10B wedged at 180°, equipped with two inlet ducts 14*a*, 14*b*, and two exhaust ducts 30*a*, 30*b*, each ending in port 16*a*, 16*b*. The section of this engine is arranged perpendicularly to the axis of each cylinder. The planes of symmetry of scavenging of both cylinders are merged and pass, as previously noted, through both axes 32*a*, 32*b* of 10A, 10B.

It is thus evident that the invention allows satisfaction of all goals noted in points 1–12 at the start of the description and in particular point 10 concerning the minimum interaxis distance allowing arrangement of a maximum cylinder capacity within a given occupied space.

According to one embodiment version, it has been envisaged that each pair of inlet ports has a port (12*a*) on one side of the plane of symmetry of scavenging noted above which is exposed by the piston for a longer time than the port (12*b*) situated on the other side of the plane of symmetry.

This results in the fact that it is possible to create an axis vortex parallel to that of the cylinder at the end of the afterfilling period in each cylinder.

It is easy to adjust the intensity in such a manner as to make optimum, in a manner known per se, preparation of the air-fuel mixture and progression of combustion which will follow in only around one quarter revolution of the crankshaft in the afterfilling phase, which per se represents an additional advantage.

It is important to note in this context that the anticipated opening of one of the ducts of one pair of inlet ducts 14*a*, 14*b* will not cause any major asymmetry (and even any asymmetry if the anticipated opening of is accomplished, not by a different height of the upper attack edge of the inlet port, but by local reduction 40 in the piston head with regard for the extent of the noted port) of the scavenging airway inside the cylinder, since the inlet ports serving for scavenging are completely exposed at the instant when the scavenging air front reaches the cylinder. It is moreover possible to compensate greater penetration of burnt gases into this duct by arranging for its communication with the scavenging air supplying before that of the other duct.

FIGS. *7a*, *7b* represent an embodiment version of a piston 22 with local reduction 40 of crest 38 in way of one of the two inlet ports to cause delayed closure of this port in relation to the other port for the purpose of creating the vortex represented by arrow T.

Moreover, according to an advantageous embodiment version of the process according to the invention, the engine is not cooled at low loadings through interruption of the cooling circuit of the engine and notably the feed paths, including the inlet ducts, whereas cooling is performed from intermediate loadings to the maximum loading by opening of the cooling circuit. The absence of cooling at low loadings makes it possible to raise the temperature of the inlet air through its heating by the walls of inlet ducts 14*a*, 14*b* themselves heated by the pre-exhaust gases. The temperature rise of the inlet gases increases their volume and produces a decrease in the volume of the residual exhaust gases in the cylinder, which favorably affects the minimum flammability threshold of the scavenging air-gas mixture principally in the case of controlled ignition engines.

Advantageously, the part of inlet ducts 12*a*, 12*b* ending in cylinder 10 is arranged to be virtually perfectly cylindrical, which largely facilitates accomplishment of shapes and the precision of their geometry.

It is thus evident that the invention incorporates all the means constituting technical equivalents of the described means represented as well as their various combinations.

I claim:

1. A system for scavenging a cylinder in a two-stroke internal combustion engine, said system comprising:

a linearly reciprocating piston disposed within said cylinder;

at least two inlet ducts each having an inlet port opening into said cylinder, each of said inlet ports for delivering an inlet stream into said cylinder; and an exhaust duct having an exhaust port opening into said cylinder, said exhaust port for delivering an exhaust stream from within said cylinder; wherein said inlet ducts and inlet ports are disposed so that each inlet stream impacts the wall of the cylinder at a substantially identical location, said location being disposed substantially between said exhaust port and an end of said cylinder opposite said piston; and wherein the edge of each of said inlet ports farthest from said opposite end and the edge of said exhaust port closest to said opposite end are arranged to substantially eliminate crossing of said inlet streams and said exhaust stream.

2. The system of claim 1, wherein:

a boundary between exhaust gases and at least one of said inlet streams is formed, said boundary being substantially perpendicular to a center axis of at least one of said inlet ducts.

3. The system of claim 2, wherein:

said location for each of said pairs being at substantially equal distance from said opposite end, said location for said inlet ducts and inlet ports being disposed substantially between said exhaust port and said opposite end.

4. The system of claim 3, wherein:

said inlet ducts are disposed symmetrically about a median plane of said cylinder, said plane containing a central axis of said exhaust duct.

5. The system of claim 4, wherein:

said inlet ducts and ports are disposed so that the inlet streams intersect at a distance of between approximately 0.5 and 0.9 of the radius of the cylinder from the longitudinal axis of the cylinder; and the closest edge of each of said inlet ports to said opposite end of said cylinder is at least as far from said opposite end as said intersection.

6. The system of claim 5, wherein:

the angle of the center of each of said inlet ports with respect to the longitudinal axis of the cylinder is between approximately 45° and 135°.

7. The system of claim 1, comprising a single pair of inlet ports, wherein:

the angle of the center of each of said inlet ports with respect to the longitudinal axis of the cylinder is between approximately 70° and 110°.

8. The system of claim 7, said piston, wherein inlet ducts opposite said inlet ports terminate below a bottom dead said system further comprising:

a storage chamber disposed within said piston; and means for connecting said inlet duct ends alternatively to said storage chamber and to an inlet stream source.

9. The system of claim 8, wherein:

one of each said inlet ports is disposed on a first side of said median plane;

the other of each of said inlet ports is disposed on a second side of said plane; and the ports are arranged with respect to the piston so that the port of said first side is exposed to the cylinder interior for a longer period of time during an engine cycle than is the port on said second side.

10. The system as claimed in claim 1, wherein the edge of said exhaust port closest to said opposite end of said cylinder lies intermediate the edge of each of said inlet ports farthest from said opposite end and said edge of said inlet ports closest to said opposite end.

11. A method for scavenging a cylinder in a two-stroke internal combustion engine, said engine comprising a linearly reciprocating piston disposed within said cylinder; at least two inlet ducts each having an inlet port opening into said cylinder, each of said inlet ports for delivering an inlet stream into said cylinder; and an exhaust duct each having an exhaust port opening into said cylinder, said exhaust port for delivering an exhaust stream from within said cylinder; wherein said inlet ducts and ports are disposed so that each inlet stream impacts the wall of the cylinder at a substantially identical location, said location being disposed substantially between said exhaust port and an end of said cylinder opposite said piston; and wherein the edge of each of said inlet ports farthest from said opposite end and the edge of said exhaust port closest to said opposite end are arranged to substantially eliminate crossing of said inlet streams and said exhaust stream, said method comprising:

providing inlet streams to each of said inlet ducts;

delivering said inlet streams to said cylinder via said inlet ports;

impacting said inlet streams at said substantially identical location to form a first deflected inlet stream;

impacting said first deflected inlet stream at a second location on the end of said cylinder opposite said piston to form a second deflected inlet stream;

impacting said second deflected inlet stream at a third location substantially opposite said substantially identical location to form a third deflected inlet stream;

impacting said third deflected inlet stream at a fourth location on said piston to form a fourth deflected inlet stream; and withdrawing said fourth deflected inlet stream from said cylinder via said exhaust port.

12. The method of claim 11, further comprising a step of:

forming a front between exhaust gases and at least one of said inlet stream and said first, second, third and fourth deflected inlet streams, said front being substantially perpendicular to a center axis of at least one of said inlet ducts.

13. The method of claim 12, wherein;

said cylinder has an axis and said inlet ducts are disposed at an angle to a plane perpendicular to the axis of said cylinder.

pairs of said at least two inlet ducts are disposed at a common angle to said cylinder axis and to said perpendicular plane; and said inlet ducts and ports of each of said pairs are disposed so that both inlet streams of a given pair impact the wall of the cylinder at a substantially identical location, said location for each of said pairs being at substantially the same distance from said opposite end, said location for each of said pairs being disposed substantially between said exhaust port and said opposite end.

* * * * *